US006019616A

United States Patent [19]

Yagi et al.

[11] Patent Number: 6,019,616

[45] Date of Patent: Feb. 1, 2000

[54] ELECTRICAL CONNECTOR WITH ENHANCED GROUNDING CHARACTERISTICS

[75] Inventors: Masanori Yagi, Ebina; Atsuhito Noda, Hachioji, both of Japan

[73] Assignee: Molex Incorporated, Lisle, Ill.

[21] Appl. No.: 09/117,404

[22] PCT Filed: Dec. 23, 1996

[86] PCT No.: PCT/US96/20251

§ 371 Date: Jul. 28, 1998

§ 102(e) Date: Jul. 28, 1998

[87] PCT Pub. No.: WO97/32366

PCT Pub. Date: Sep. 4, 1997

[30] Foreign Application Priority Data

Mar. 1, 1996 [JP] Japan ..... 8-071514

[51] Int. Cl.[7] ..... H01R 13/658

[52] U.S. Cl. ..... 439/108; 439/607

[58] Field of Search ..... 439/101, 108, 439/607, 608

[56] References Cited

U.S. PATENT DOCUMENTS

| | | | |
|---|---|---|---|
| 4,950,172 | 8/1990 | Anhalt et al. | 439/607 |
| 4,959,024 | 9/1990 | Czeschka | 439/607 |
| 5,030,140 | 7/1991 | Sugiyama | 439/607 |
| 5,035,631 | 7/1991 | Piorunneck et al. | 439/630 |
| 5,057,041 | 10/1991 | Yu et al. | 439/620 |
| 5,174,771 | 12/1992 | Burgit | 439/108 |
| 5,176,538 | 1/1993 | Hansell, III et al. | 439/607 |

FOREIGN PATENT DOCUMENTS

| | | |
|---|---|---|
| WO96/249969 | 8/1996 | WIPO . |
| WO97/32366 | 7/1997 | WIPO . |

*Primary Examiner*—Gary Paumen
*Attorney, Agent, or Firm*—Charles S. Cohen

[57] ABSTRACT

An electrical connector having enhanced grounding characteristics utilizes an insulating housing with a plurality of conductive terminals mounted inside, and a metal grounding shield covering the connector housing. The grounding shield has at least one grounding lead piece formed integrally therewith and bent inwardly. The grounding lead extends into contact with a selected terminal inside of the connector to thereby function as a grounding terminal to provide a convenient grounding path in close proximity to the grounding circuit when high-frequency current signals are induced in the grounding shield.

21 Claims, 5 Drawing Sheets

ELECTRICAL CONNECTOR WITH ENHANCED GROUNDING CHARACTERISTICS

BACKGROUND OF THE INVENTION

The present invention generally relates to electric connectors, and more particularly, to connectors having enhanced grounding characteristics, which are appropriate for use in high-frequency circuits.

Electric connectors are often used in connecting printed circuit boards together. In the construction of such connectors, it is known to use a metal shield to surround the insulative housing in order to preventing the leakage of high-frequency signals from the joint(s) at which the printed circuits boards or associated electric parts are connected together. Examples of high-frequency connectors using metal shields are disclosed in Japanese Patent Application Laid-Open Nos. 4-255678 and 5-217630. These high-frequency connectors use an insulative housing with a plurality of terminals fixed in the interior of the housing and a metal shield fixed to the exterior of the housing, and are designed so as to ground any high-frequency signals appearing on any terminals by way of the metal shield. The inner terminals, the exterior shield and the intervening insulative housing combine to act as a capacitor and capacitive coupling occurs which passes the high-frequency signals of the terminals to the grounding shield.

However, in such constructions, there is an appropriate fear of permitting local high-frequency paths which occur between the terminals and the metal shield to function as antennas, thus causing radiation of high-frequency signals to neighboring terminals. In an attempt to avoid this type of interference between terminals disposed along the opposing longitudinal sides of the connector which carry high-frequency signals, the exterior metal shield is grounded at the opposing ends of the connector. However, as the length of the connector increases and the number of terminals which extend along the longitudinal extent of the connector also increases, the likelihood of an antenna effect occurring between the metal shield and terminals likewise increases. The increased size of the connector and increased number of terminals increases the likelihood of inducing undesired signals because the grounded ends of the connector move farther away from the high-frequency terminals and because the high-frequency signals seek a low impedance path to ground, they tend to propagate through a nearby terminal and through the circuitry of the printed circuit board rather than the groundpaths at the ends of the connector.

The present invention is directed to an improved connector which avoids the aforementioned shortcomings and reduces the likelihood of an antenna effect from occurring that will lead to radiation of high-frequency signals by increasing the number of groundpaths along the length of the connector.

SUMMARY OF THE INVENTION

One object of the present invention is to provide an electrical connector with an enhanced grounding capability for high-frequency signals.

Another object of the present invention is to provide an electrical connector having an insulative housing, an interior recess which accommodates a plurality of electrically conductive terminals disposed therealong and an exterior metal grounding shield, the grounding shield having a plurality of ground connections extending into contact with selected terminals of the connector, thereby increasing the number of groundpaths along the length of the connector.

Still another object of the present invention is to provide an electrical connector having a connector body formed from an insulating material, a longitudinal recess disposed in the connector body, a plurality of terminals disposed in spaced-apart order within the recess and having solder tail portions that extend exterior of the connector body portion, a metal grounding shield disposed exterior of the connector body, the grounding shield having a plurality of grounding terminals spaced along the length of the connector which extend inwardly through the connector body into electrical contact with selected ones of the connector terminals to thereby define a series of groundpaths disposed along the length of the connector.

To attain these and other objects, an electrical connector of a ground enhancement type comprises an insulating housing having a plurality of terminals mounted inside and a metal shield covering at least one portion of the insulating housing. The metal shield has one or more leads integrally connected thereto and extending outwardly therefrom, the leads being stamped and formed so that they extend inwardly through aligned apertures of the insulating housing into contact with selected terminals inside of the connector.

The present invention can be equally applied to any surface mount connectors, such as plug or receptacle type connector components as well as circuit card connectors, such as edge card connectors.

In an electrical connector constructed in accordance with the principles of the present invention, the selected terminal (s) that contact the shield leads can be used as grounding terminals, thereby permitting any high-frequency current induced in the metal shield to propagate along the shortest possible path to an associated grounding circuit. Thus, any antenna effect that may occur locally in the metal shield when a high-frequency current is induced therein can be substantially reduced so that transmission of undesired high-frequency signals via other terminals may be prevented.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF THE PREFERRED EMBODIMENTS

Figure 1:
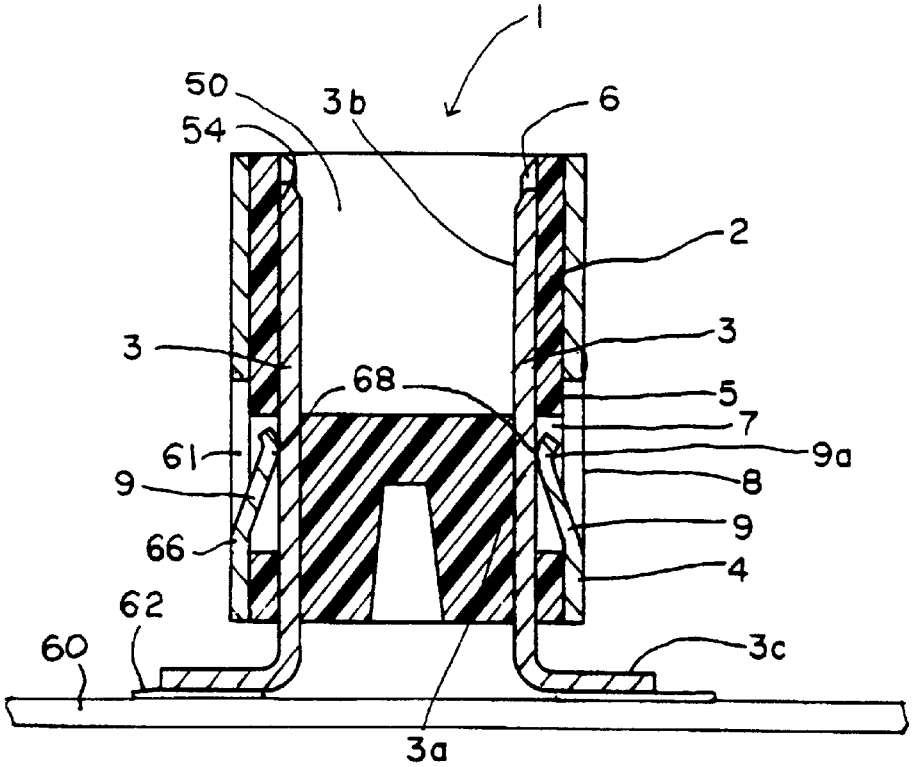
FIG. 1 is a cross-sectional view of a connector component, such as a plug connector, constructed in accordance with the principles of the present invention.

Referring now to FIG. 1, a plug connector 1 with enhanced grounding characteristics constructed in accordance with the principles of the present invention is shown as comprising an elongated insulative housing 2 having an interior recess 50 defined by a pair of housing sidewalls 5. The recess 50 is dimensioned to receive an opposing interengaging connector component and in other embodiments, may receive a circuit card therein. A plurality of terminals 3 are longitudinally arranged on opposing inner surfaces 54 of the connector sidewalls 5 at regular intervals. A conductive shield 4, preferably a metal shield, covers the sidewalls 5 of the connector housing 2.

The terminals 3 each comprise a contact portion 3*b* which is located in the recess 50 and which extends vertically from intermediate body portions 3*a* of the terminals 3 to near the top of the recess 50. Solder tail portion 3*c* extend away from the intermediate portions 3*a* in a horizontal manner and out of the connector 1 in order to permit the connector 1 to be mounted in an associated stationary plane, such as to a circuit board 60, wherein the solder tail portions 3*c* oppose and engage contact pads 62 of circuits of the circuit board 60.

Figure 4:
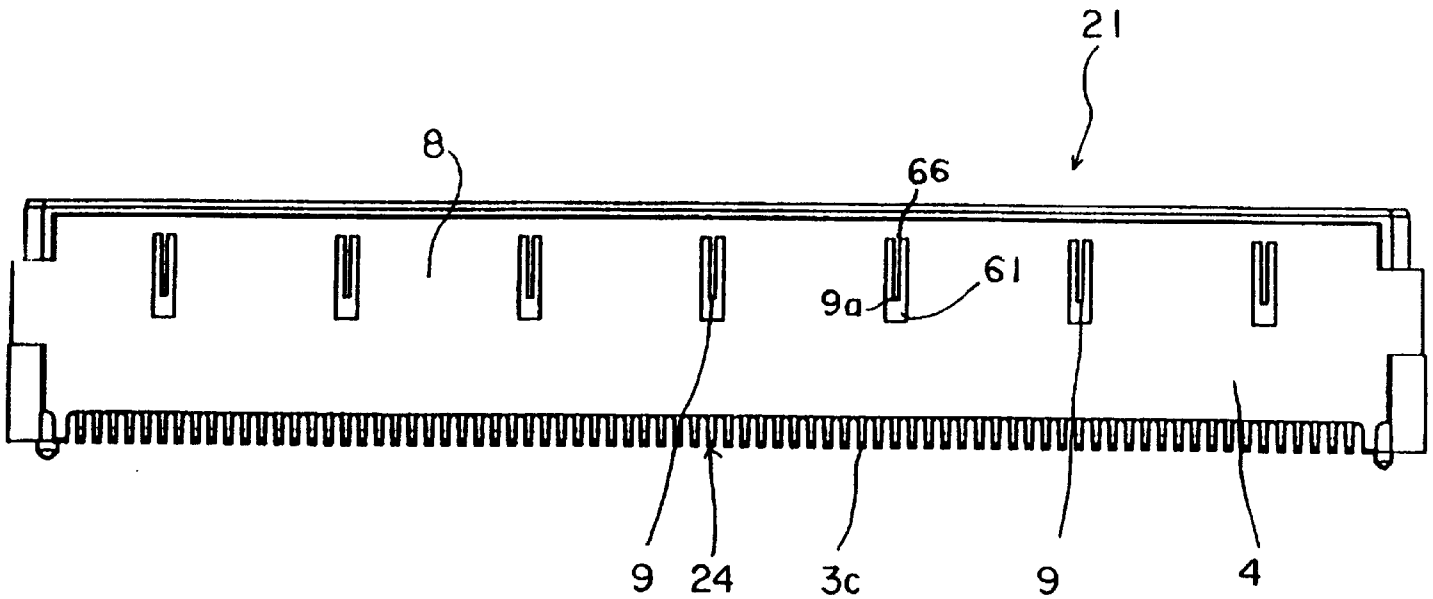
FIG. 4 is an elevational view of the plug connector component of the electrical connector assembly of FIG. 3.

In an important aspect of the present invention, the connector housing 2 has a series of apertures 7 formed therein, preferably in the form of slots. These apertures 7 may be located in either the connector sidewalls or in the base or body portion of the connector housing 2 and are aligned with specific ones of the terminals 3, for example, every 5th or 10th terminal. The metal grounding shield 4 has a series of corresponding grounding leads 9 formed along the horizontal extent 8 of the shield, and each such grounding lead 9 is preferably formed by stamping a window-like opening 61 (having an U-shape as illustrated in FIG. 4) into the horizontal body portion 8 of the shield 4. The openings 61 define opposing free ends 64 and tail ends 66 for each grounding lead 9. The grounding leads 9 are integrally attached to the grounding shield 4 while their free ends 64 are not, so that they may be easily formed, such as by bending inwardly, and placed into contact with the selected associated terminals 3, the contact being illustrated in FIGS. 1 & 2 as occurring between the body portions 3*a* of the terminals 3 and contact portion 68 of the grounding leads 9 formed on their free ends 64.

Figure 2:
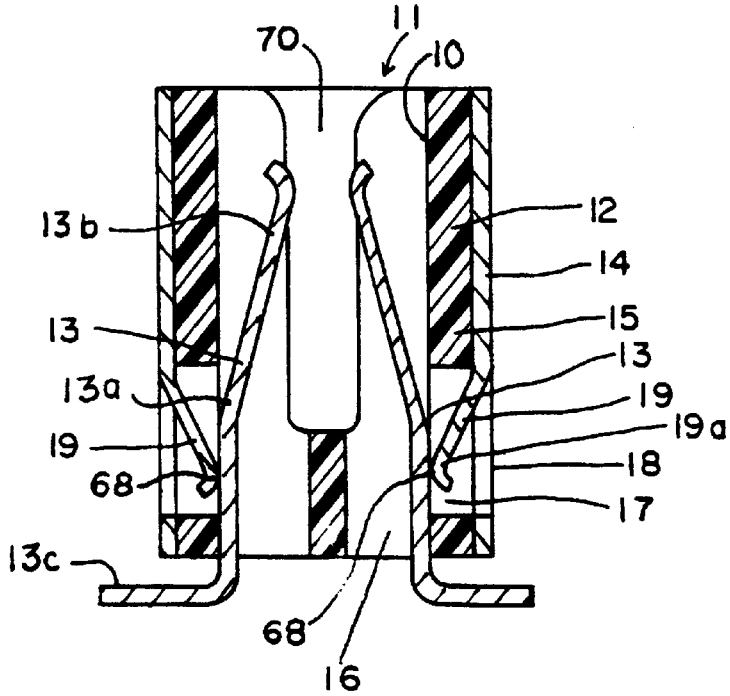
FIG. 2 is a cross-sectional of another connector component, such as a receptacle connector, constructed in accordance with the principles of the present invention.

Referring now to FIG. 2, a receptacle connector 11 with enhanced ground characteristics and which is constructed in accordance with the principles of the present invention is illustrated and, according to one embodiment, comprises an elongated insulating housing 12 with a plurality of terminals 13 longitudinally arranged on the opposing interior surfaces 10 of the walls 15 of the housing 12 at regular intervals. A metal grounding shield 14 covers the walls 15 of the housing 12. The terminals 13 include contact portions 13*b* which extend vertically within the receptacle connector recess 70, body portions 13*a* which are embedded in the connector housing 12 and solder tail portions 13*c* which extend through the base 16 of the connector housing 12 and away therefrom to provide an engagement plane at which the connector may be mounted to a printed circuit board similar to the manner of mounting shown in FIG. 1.

Selected terminal slots in the form of through apertures 17 are formed in the body portion 18 of this connector 11 and provide an opening that permits a grounding lead 19 to extend therethrough into contact with the interior conductive terminals 13 of the connector 1. The metal shield 14 has a plurality of grounding leads 19 stamped and bent inward so that they pass through the apertures 17 in order to resiliently contact the intermediate sections 13*a* of the connector terminals 13, the contact being made by the free ends 19*a* of the grounding leads 19. This contact establishes electrical connections between the metal grounding shield 14 and the selected terminals 13.

In operation, the selected terminals 3, 13 of the connector components 1, 11 which are contacted by the associated grounding leads 9, 19 of the grounding shields 4, 14 act as grounding terminals. These terminals 3, 13 are connected to grounding circuits of the associated printed circuits boards 60 to which the connector components are mounted. When high-frequency signals are transmitted through certain terminals of the connector components 1, 11, capacitive coupling occurs between these terminals and the exterior metal shields 4, 14 spaced apart from the terminals and the signals, in essence, "jump" through the insulative housings 2, 12 to the metal shields 4, 14. These signals seek a ground and in the prior art connectors mentioned hereinabove, they traversed the length of the metal shield to the ends of the connector where these shields had ground leads located at their ends. However, as the length of the connectors increase as more terminals are added, the shield becomes longer in length and the impedance experienced by the high-frequency signals grows as the signals traverse the length of the shield. The long shield in these prior art applications therefore acts as a radiating antenna and the high-frequency signals are then likely to jump back through the insulative housing to adjoining terminals rather than traversing the length of the metal shield to the ground leads at the ends thereof. This may lead to errant transmission of high-frequency signals to wrong circuit terminals.

The present invention advantageously defines a plurality of groundpaths spaced at predetermined intervals along the length of the connector components 1, 11 by way of the metal shield grounding leads 9, 19. The grounding leads 9, 19 therefore define segments of the grounding shields 4, 14 of predetermined length 1, which is less than the entire length L of the connector (FIG. 4) so that any high-frequency signals which are transmitted by the terminals 3, 13 and which become capacitively coupled to the metal shields 4, 14 travel the shortest possible length to a ground circuit, thereby substantially reducing, if not altogether eliminating any antenna effect which would transmit high-frequency signals to the wrong terminals of the connector components 1, 11.

Figure 6:
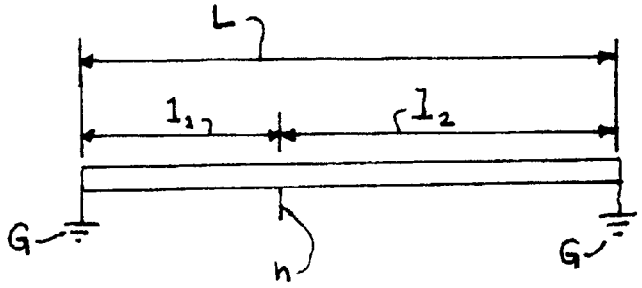
FIG. 6 is a schematic view of prior art grounded connector.
Figure 7:
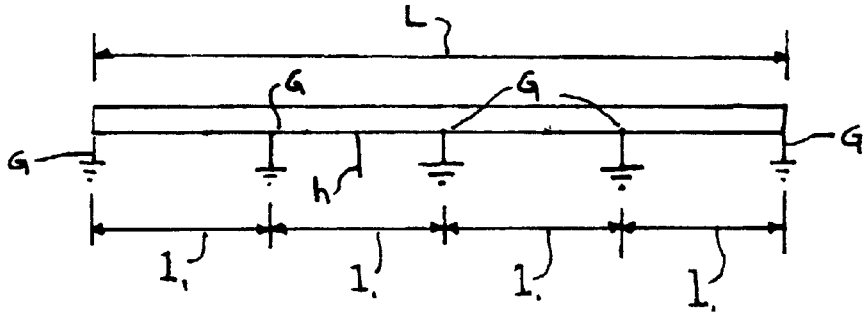
FIG. 7 is a schematic view of the connector of FIG. 3.

This relationship is best understood with reference to FIGS. 6 & 7. In FIG. 6, a schematic of a prior art grounded connector is illustrated of length L which has two ground connections G located at its opposite ends. Where a connector terminal h carries a high-frequency signal and the signal jumps from the terminal to the exterior grounding shield, the signal must travel a distance of either $1_1$ or $1_2$ to reach either of the grounds G. These lengths may create an antenna effect as described above as the overall length L of the connector increases.

However, in the present invention, especially when multiple grounding leads are used at specific intervals, the distance to the nearest groundpath is considerably shortened. FIG. 7 schematically illustrates a connector of the present invention with three grounding leads G formed in its grounding shield at equal distance intervals $\mathbf{1}_1$. These intervals $\mathbf{1}_1$ serve to reduce the shortest distance from any high-frequency terminal h in this connector to a distance no greater than a fractional value of the length of the connector equal to $$\frac{1}{N+1}$$

where N=the number of grounding leads used on any longitudinal extent of the connector. In FIG. 7, three grounding leads are used so that the shortest distance to any groundpath is approximately no greater than one-fourth, i.e., $$\left(\frac{1}{3+1}\right)\times L$$

of the length L of the connector. Importantly, because the grounding leads 9, 19 effect contact with their associated selected grounding terminals at a level above the solder tail portions 3*c*, 13*c* of the terminals 3, the grounding leads 9, 19 of the grounding shields 4, 14 will not affect the coplanarity of the solder tail portions 3*c*, 13*c* of the connectors 1, 11.

The number, position and spacing of the grounding lead 9, 19 of the grounding shields 4, 14 will be determined in advance upon due consideration of which terminals of the connector components 1, 11 high-frequency signals are applied. In instances where such high-frequency signals are applied to only one or two terminals, a single grounding lead may be used to contact one selected terminal in the close proximity to the high-frequency signal transmission terminals.

Figure 3:
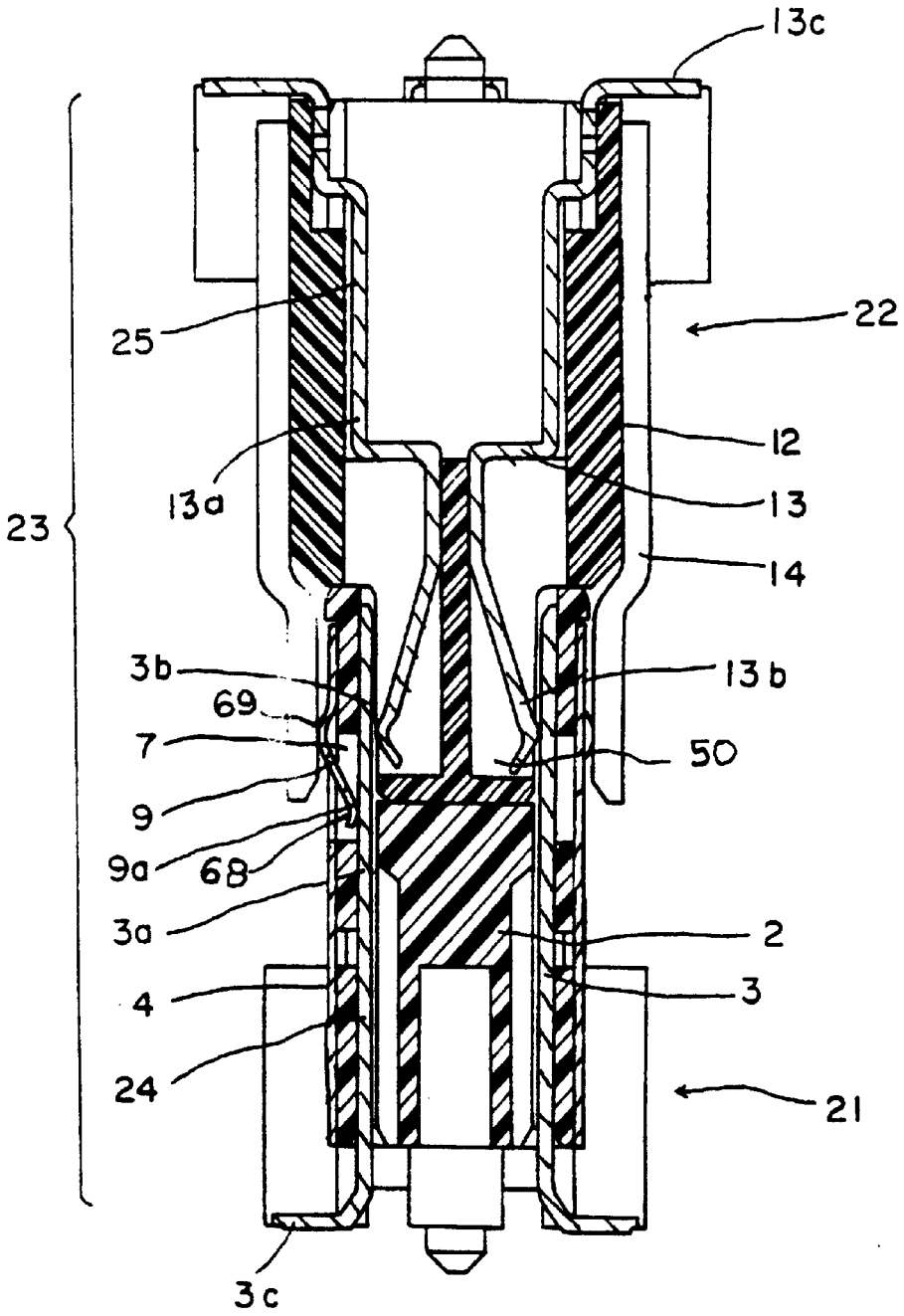
FIG. 3 is an enlarged cross-sectional view of an electrical connector assembly utilizing two interengaging connector components wherein one connector component is a plug connector constructed in accordance with the principles of the present invention and the other connector component is a conventional receptacle connector.
Figure 5:
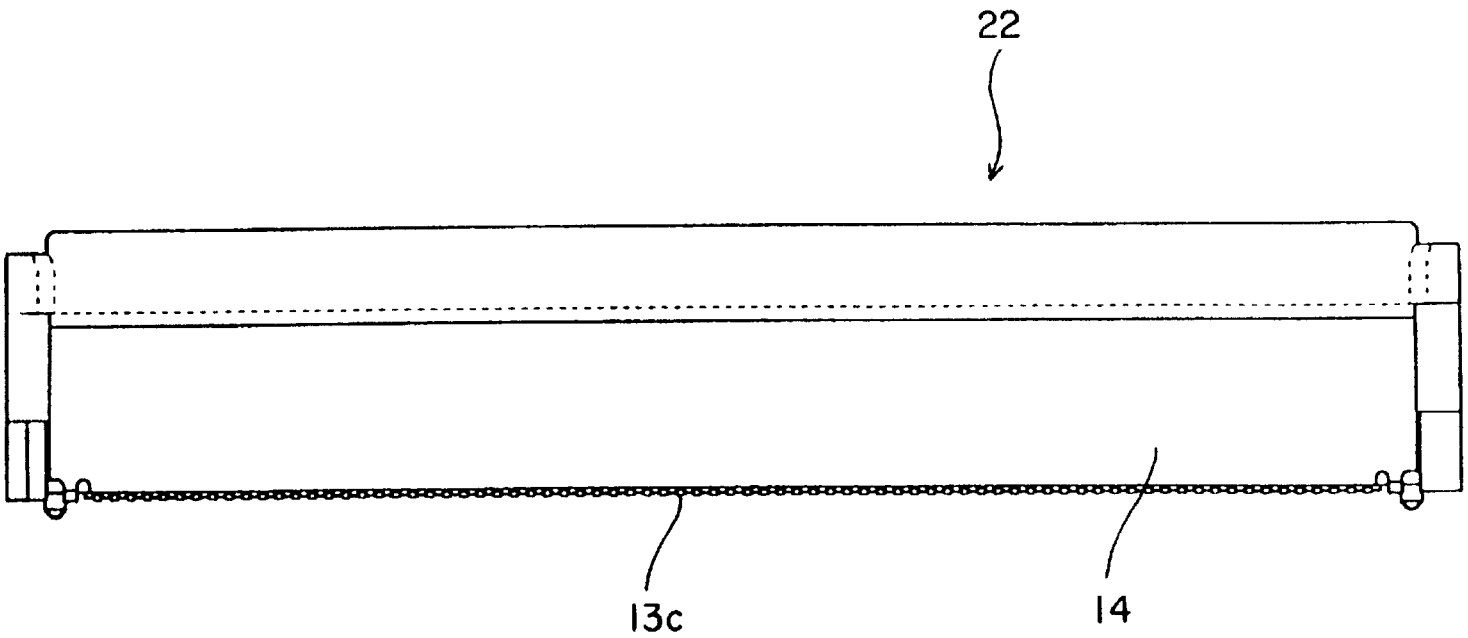
FIG. 5 is an elevational view of the receptacle connector of the electrical connector assembly of FIG. 3.

Referring now to FIG. 3, an electrical connector assembly 23 is illustrated wherein a plug connector component 21 similar in construction to that of FIG. 1 is in engagement with an ordinary receptacle connector component 22. FIG. 4 presents a front elevational view of the plug connector component 21 whereas FIG. 5 presents a frontal elevational view of the receptacle connector component 22. In these drawings, the same reference numerals as used in FIG. 1 are used to indicate similar parts and the descriptions are omitted. The grounding terminals 24 of the plug connector component 21, which contact with the grounding leads 9 of the metal shield 4, are connected to grounding circuits on an associated circuit board (not shown), and the countertermi-nals 25 of the opposing, interengaging receptacle connector component 22, which contact likewise the grounding terminals 24 of the plug connector component 21, are connected to the grounding circuit. The contact portions 68 of the grounding leads 9 make contact with the grounding terminals 24 of the plug connector component 21, while backbone portions 69 of the terminals 9 extend in the opposite directions i.e., exterior of the connector component 21, to contact the grounding shield 14 of the receptacle connector component 22.

As may be understood from the above, high-frequency current signals induced in the metal shield are thereby permitted to travel the shortest possible path to a grounding circuit, thereby minimizing the antenna effect to prevent transmission of undesired high-frequency signals via wrong terminals.

It will be understood that the present invention will have equal applicability in circuit card connectors wherein the recess of the connector receives a printed circuit card, such as an edge card, rather than an opposing interengaging connector component.

It will be appreciated that the embodiments of the present invention discussed herein are merely illustrative of a few applications of the principles of the invention. Numerous modifications may be made by those skilled in the art without departing from the true spirit and scope of the invention.

We claim:

1. In an electrical connector having an elongated connector housing formed from an insulative material, the housing having a recess extending longitudinally therein between opposing ends, the housing recess being defined at least in part by a pair of connector sidewalls, a plurality of conductive terminals arranged along opposing interior surfaces of said connector sidewalls, and a metal grounding shield disposed on exterior surfaces of said connector and which is aligned with said terminals, the improvement comprising:

at least one of said conductive terminals being a grounding terminal, and the grounding shield having at least one grounding lead formed therein and extending through corresponding openings formed in said connector housing and into electrical contact with said grounding terminal of said connector terminals to define a groundpath between said grounding shield and said grounding terminal.

2. The connector as defined in claim 1, wherein said grounding shield has a plurality of grounding leads formed therein in opposition to said grounding lead, and said conductive terminals include a like plurality of grounding terminals, said grounding leads extending through said connector housing into electrical contact with said grounding terminals to define a plurality of individual groundpaths on said connector.

3. The connector as defined in claim 1, wherein said connector housing includes an aperture formed therein and said grounding lead extends through said aperture into contact with said one grounding terminal.

4. The connector as defined in claim 1, wherein said grounding shield includes a body portion, the grounding shield body portion having a window stamped therein which partially surrounds said grounding lead and defines a free end and a tail end of said grounding lead, said grounding lead tail end being integral with said grounding shield body portion.

5. The connector as defined in claim 4, wherein said connector housing includes an aperture formed therein in opposition to said grounding lead and said grounding lead free end extends through said housing aperture into contact with said grounding terminal.

6. The connector as defined in claim 3, wherein said aperture is formed in one of said connector sidewalls.

7. The connector as defined in claim 2, wherein said connector housing has a plurality of apertures formed therein, aligned with and in opposition to said grounding leads, said grounding leads having free ends which extend through said apertures into contact with said grounding terminals.

8. The connector as defined in claim 2, wherein said grounding shield extends along exterior surfaces of said connector housing sidewalls.

9. The connector as defined in claim 1, wherein said grounding shield is disposed on an exterior surface of one of said connector housing sidewalls such that said grounding shield and some of said connector terminals lie on opposite sides of at least one of said connector housing sidewalls.

10. The connector as defined in claim 8, wherein said grounding shield covers substantially all of said connector housing sidewall exterior surfaces.

11. The connector as defined in claim 2, wherein said grounding leads are spaced along the length of said grounding shield in predetermined intervals.

12. The connector as defined in claim 11, wherein said intervals are irregular.

13. The connector as defined in claim 1, wherein said connector recess is adapted to receive an opposing interengaging connector component therein.

14. The connector as defined in claim 2, wherein said grounding shield has a prespecified number of grounding leads formed therein which contact a like number of grounding terminals of said connector and wherein the distance between any conductive terminal and the nearest groundpath of said connector is approximately no greater than:

$$\frac{1}{N+1} \times L$$

where L=the length of the connector

N=the number of grounding leads.

15. An electrical connector with enhanced grounding characteristics, comprising:

a connector housing formed from an insulative material, the connector housing having an elongated body portion, the connector housing having a circuit component-receiving recess defined in said connector body portion by two opposing sidewalls extending longitudinally along said connector body portion on opposite sides of said circuit component-receiving recess, said connector housing having two end portions joining said sidewalls together;

a plurality of conductive terminals disposed in said circuit component-receiving recess and arranged in a predetermined order within said circuit component-receiving recess, said terminals being disposed adjacent opposite surfaces of said circuit component-receiving recess, the terminals having contact portions disposed within said circuit component-receiving recess, solder tail portions extending out of said connector housing and positioned for attachment to a plurality of associated circuit pads on an associated printed circuit board, and said terminals having body portions intermediate of said contact and solder tail portions thereof and extending within said connector housing body portion;

a conductive grounding member disposed along exterior surfaces of said connector housing in alignment with said terminals such that said insulative housing separates said grounding member from said terminals, the grounding member having a plurality of individual grounding leads formed therein which extend from said grounding member through said housing into electrical contact with a like plurality of corresponding grounding terminals of said connector terminals to thereby establish a plurality of distinct groundpaths between said grounding member and said corresponding grounding terminals at selected intervals along the length of said connector to thereby shorten the distance from any non-grounding terminal to any of said groundpaths to a fractional value of said connector length.

16. The connector as defined in claim 15, wherein said grounding member includes a metal grounding shield.

17. The connector as defined in claim 15, wherein said grounding leads are stamped and formed in said grounding member to define, for each of said grounding leads, a free end and a base portion opposite said free end, the base portion being integral with said grounding member.

18. The connector as defined in claim 15, further including a plurality of apertures formed in areas of said connector housing between said grounding member and said grounding terminals and aligned in opposition with said grounding terminals, said grounding leads extending through said connector housing by way of said apertures and into contact with said grounding terminals.

19. The connector as defined in claim 15, wherein said grounding member includes a plurality of U-shaped openings associated with said grounding leads, the U- shaped openings defining a free end for each grounding lead, the grounding lead free ends being inclined at an angle to said grounding member so that said free ends extend inwardly through said connector housing into contact with said grounding terminals.

20. The connector as defined in claim 19, wherein said connector housing includes a plurality of apertures aligned with said U-shaped openings, whereby said grounding lead free ends extend through said apertures into contact with said contact portions of said grounding terminals.

21. The connector as defined in claim 15, wherein said connector has N groundpaths defined in said grounding member along one side of said connector and wherein said fractional value is approximately no greater than:

$$\frac{1}{N+1} \times L$$

where L=the length of the connector, and

N=the number of groundpaths.

* * * * *